US007030871B2

(12) United States Patent
Kitagawa et al.

(10) Patent No.: US 7,030,871 B2
(45) Date of Patent: Apr. 18, 2006

(54) ACTIVE MATRIX DISPLAY DEVICE

(75) Inventors: Makoto Kitagawa, Gifu (JP); Mitsugu Kobayashi, Aichi (JP); Makoto Fujioka, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 199 days.

(21) Appl. No.: 10/206,800

(22) Filed: Jul. 29, 2002

(65) Prior Publication Data

US 2003/0030607 A1 Feb. 13, 2003

(30) Foreign Application Priority Data

Jul. 27, 2001 (JP) ..... 2001-228044
Jul. 27, 2001 (JP) ..... 2001-228045
Jul. 27, 2001 (JP) ..... 2001-228046

(51) Int. Cl.
*G09G 5/00* (2006.01)

(52) U.S. Cl. ..... 345/213; 345/98; 345/534

(58) Field of Classification Search ..... 345/92, 345/98, 99, 100, 204, 211–213, 533, 534, 345/545; 348/425.4, 431.1, 439.1
See application file for complete search history.

(56) References Cited

U.S. PATENT DOCUMENTS 5,712,652 A * 1/1998 Sato et al. ..... 345/90
5,945,972 A * 8/1999 Okumura et al. ..... 345/98
5,952,991 A * 9/1999 Akiyama ..... 345/98
6,331,844 B1 * 12/2001 Okumura et al. ..... 345/87
6,741,229 B1 * 5/2004 Yanagi et al. ..... 345/98
6,771,247 B1 * 8/2004 Sato et al. ..... 345/98
2001/0024187 A1 * 9/2001 Sato et al. ..... 345/98

* cited by examiner

*Primary Examiner*—Henry N. Tran
(74) *Attorney, Agent, or Firm*—Morrison & Foerster LLP

(57) ABSTRACT

This invention is directed to the active matrix display device with an imaging speed rapid enough for the moving image display and the small power consumption. The selector makes the switch between the moving image mode, where the image signal consecutively inputted is consecutively displayed after the certain processing is performed by the data processing unit and the still image mode, where the display is made based on the image signal stored in the frame memory. The messy display upon the switching between the modes can be prevented by differentiating the switching timing of the still to moving image mode from that of the moving to still image mode, improving the display quality.

24 Claims, 5 Drawing Sheets

ACTIVE MATRIX DISPLAY DEVICE

BACKGROUND OF THE INVENTION

1. Field of the Invention

This invention relates to a display device, which makes a selection between two display modes; a moving image mode where an image signal consecutively inputted is consecutively displayed and a still image mode where an image signal stored in a frame memory is displayed.

2. Description of the Related Art

With the spread of personal digital assistant (PDA) in recent years including cellular phone and laptop personal computer, the liquid crystal display (LCD) device and electric luminescence (EL) display device have been used widely as they have relatively small power consumption.

FIG. 4 shows a circuit diagram of an active matrix LCD as an example of a conventional display device. In the active matrix display device, a controlling circuit 200 is connected to a LCD panel 100.

The LCD panel 100 comprises a first substrate with a plurality of pixel electrodes and a second substrate with a single common electrode 10 facing to a plurality of the pixel electrodes with a liquid crystal sandwiched between the first and second substrates. On the first substrate, a plurality of the pixel electrodes 1 and a pixel TFT 2 for switching having a thin film transistor (TFT) for each of the pixel electrodes are placed in a matrix configuration. A gate line 3 is placed in the row direction and a data line 4 is placed in the column direction of the matrix of the pixel electrodes 1. The gate line 3 is connected to the gate of the each pixel TFT 2 and the data line 4 is connected to the drain of the each pixel TFT 2. Also, the gate line 3 is connected to a gate line shift register 5 placed near the display area. The data line 4 is connected to a data bus line 7 through a data line selection TFT 6, the gate of which is connected to the output terminal of a data line shift register 8. The data line selection TFT 6 and the data line shift register 8 configure a data line driver for consecutively selecting the data line 4 and supplying the data signal. Also, a storage capacitor 9 for storing a pixel voltage is placed for each of the pixel along with a liquid crystal capacitor placed in parallel.

The control circuit 200 has a data processing unit 21, a CPU interface 22, a timing controller 23, and a digital-analog converter (DAC) 24. When an analog image signal is inputted, the data processing unit 21 produces a signal suitable for the LCD panel by performing the sampling with an adequate timing, converting the signal into digital signal, adjusting the brightness and contrast, and applying the gamma correction. The CPU interface 22 receives a command of a CPU, not shown in the figure, which controls a device with a LCD such as PDA and cellular phone, and sends the controlling signal out to each part of the device based on the command received. The timing controller 23 outputs various kinds of timing signal to the LCD panel 100 based on a vertical start signal and a horizontal synchronous signal extracted from the image signal. The DAC 24 converts a RGB digital data outputted from the data processing unit 21 into the voltage suitable for the pixel voltage of the LCD panel 100 and outputs the converted voltage.

Next, the operation of the active matrix LCD, along with the driver control signal, will be explained. FIGS. 5 and 6 are the timing charts showing several timing signals. A vertical synchronous signal Vsync is a clock outputting a "high level"0 every time when a vertical synchronous period begins for indicating the start of one frame period. A vertical start signal STV is inputted to the gate line shift register 5.

The gate line shift register 5 is a shift register, which starts the operation in response to the vertical start signal STV. A gate line clock CKV is inputted to the gate shift register 5 and the shift register for each of the gate line clock CKVs consecutively supplies the gate signal to the gate line 3. Half a cycle of the gate line clock CKV is equal to the horizontal synchronous period. Entire pixel TFTs 2 connected to the gate line 3 provided with the gate signal turn on. The horizontal start signal STH is inputted to the data line shift register 8 of the date line driver. The data line shift register 8 starts the operation in response to the horizontal start signal STH. A data line clock CKH is inputted to the data shift register 8 and the out put of the data shift register 8 changes for each of the data line clock CKHs, consecutively supplying the data line selection signal to the data line selection TFT 6. The data line selection TFT 6 provided with the data line selection signal turns on and the data signal DATA is supplied to the pixel electrode 1 from the data bus line through the data line 4 and the pixel TFT 2. As shown in the figure, there is a plurality of the data bus lines 7. By supplying the same gate signal to the data line selection TFT 6 corresponding to each of the data bus lines, the pixel voltage is simultaneously applied to a plurality of the pixel electrodes 1. After completing the selection of all the data lines 4 by the data shift register 8, the gate line clock CKV is inputted again for selecting the next gate line 3. After completing the selection of all the gate lines 3 by the gate shift register 5, display, of one screen image is completed. Every time data for one row, or, for example, the data for 176 pixels is written, there is a horizontal blanking period, where no data is inputted for a certain period of time. Also, every time the data for entire pixels, or the data for 220 rows, is written, there is a vertical blanking period, where no data is inputted for a certain period of time (for several horizontal period). During the vertical blanking period, the next vertical synchronous signal Vsync is inputted, starting the next frame and repeating the same procedure mentioned above from the beginning.

In the PDA such as cellular phone, the reduction of the power consumption is indispensable for a longer operation period. Therefore, in cellular phone, a display device with a frame memory capable of storing image data for one screen display is widely used and the display is made by using the data stored in the frame memory. FIG. 7 shows the circuit diagram of the display device with a frame memory. The same components as those in FIG. 4 have the same reference numerals as in FIG. 4 and the explanation about these configurations will be omitted. The frame memory 25 is a SRAM, which stores the digital image data of the entire pixels of the liquid crystal panel 100 inputted through the CPU interface 22. The image data stored in the frame memory 25 is converted into the pixel voltage by the DAC 24 and then supplied to each of the pixel electrodes.

When the image data stored in the frame memory 25 is displayed, it is necessary to produce the timing signal because the timing signal such as the vertical synchronous signal Vsync is not supplied from outside. An oscillator 26 produces a base clock and supplies it to the timing controller 23. The timing controller 23 produces the data line clock CKH by multiplying the frequency of the basic clock. A counter in the timing controller counts the base clock for outputting one pulse for a predetermined number of data line clocks, producing the horizontal start signal STH and the gate line clock CKV. Also, another counter counts the base clock, producing the vertical start signal STV.

One of the advantages of the display device with the frame memory 25 is that the power consumption is relatively small since there is no need to input the display data from outside. However, it is necessary to, first, store the image data in the frame memory 25, requiring a certain amount of time for storing. Thus, the device does not have an enough imaging speed for displaying a moving image.

SUMMARY OF THE INVENTION

This invention is directed to a display device with relatively small power consumption capable of displaying a moving image.

The active matrix display device of this invention has a plurality of gate lines, a plurality of data lines disposed in the direction perpendicular to the gate line, a switching element placed at the crossing of the gate line and the data line, and a plurality of pixel electrodes connected to each of the switching elements. An image signal is supplied to the entire pixel electrodes from the data line for each frame period. And the active matrix display device displays an image based on the pixel voltage between the pixel electrode and the common electrode. The active matrix display device has a moving image mode, where a moving image is displayed based on the output of the data processing unit which performs a certain processing on consecutively inputted image signal and a still image mode, where a still image is displayed based on the output of the memory which stores the image signal of a plurality of the pixels.

Also, the switching timing from the still image mode to the moving image mode differs from the switching timing from the moving image mode to the still image mode.

As to the switching timing from the still image mode to the moving image mode, when a first switching signal, which switches from the still image mode to the moving image mode, is received during one frame period, the still image mode continues until the end of the frame period and the moving image mode begins at the next frame period.

Likewise, as to the switching timing from the moving image mode to the still image mode, when a second switching signal, which switches from the moving image mode to the still image mode, is received during one frame period, the image signal is read out from the address of the memory corresponding to the pixel supplying the pixel voltage at this moment and the switching to the still image mode is immediately performed.

DETAILED DESCRIPTION OF THE INVENTION

Figure 1:
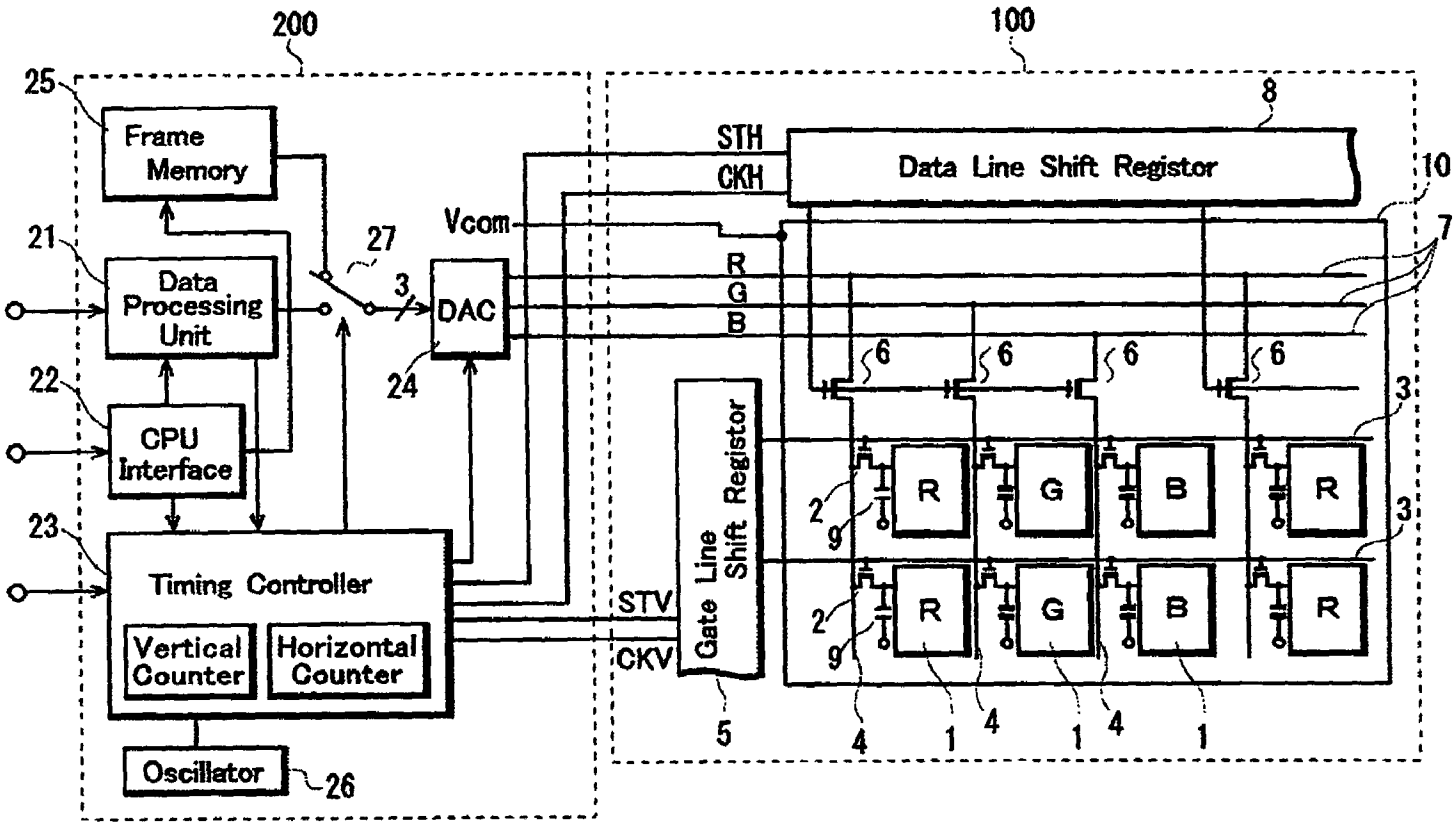
FIG. 1 is a circuit diagram of the active matrix liquid crystal display device showing an embodiment of this invention.
Figure 4:
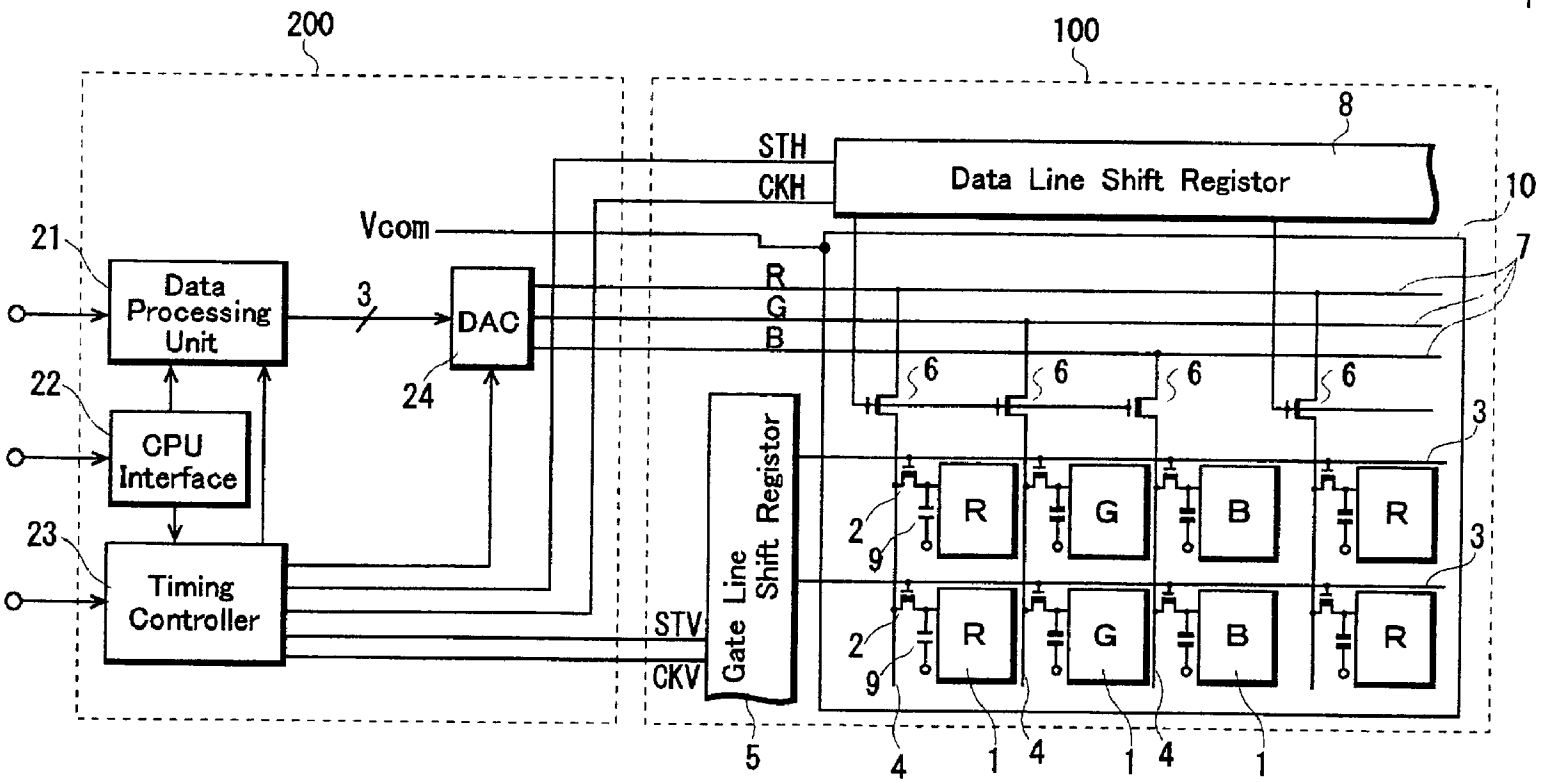
Fig.4 PRIOR ART
FIG. 4 is a circuit diagram of a conventional active matrix liquid crystal display device.
Figure 7:
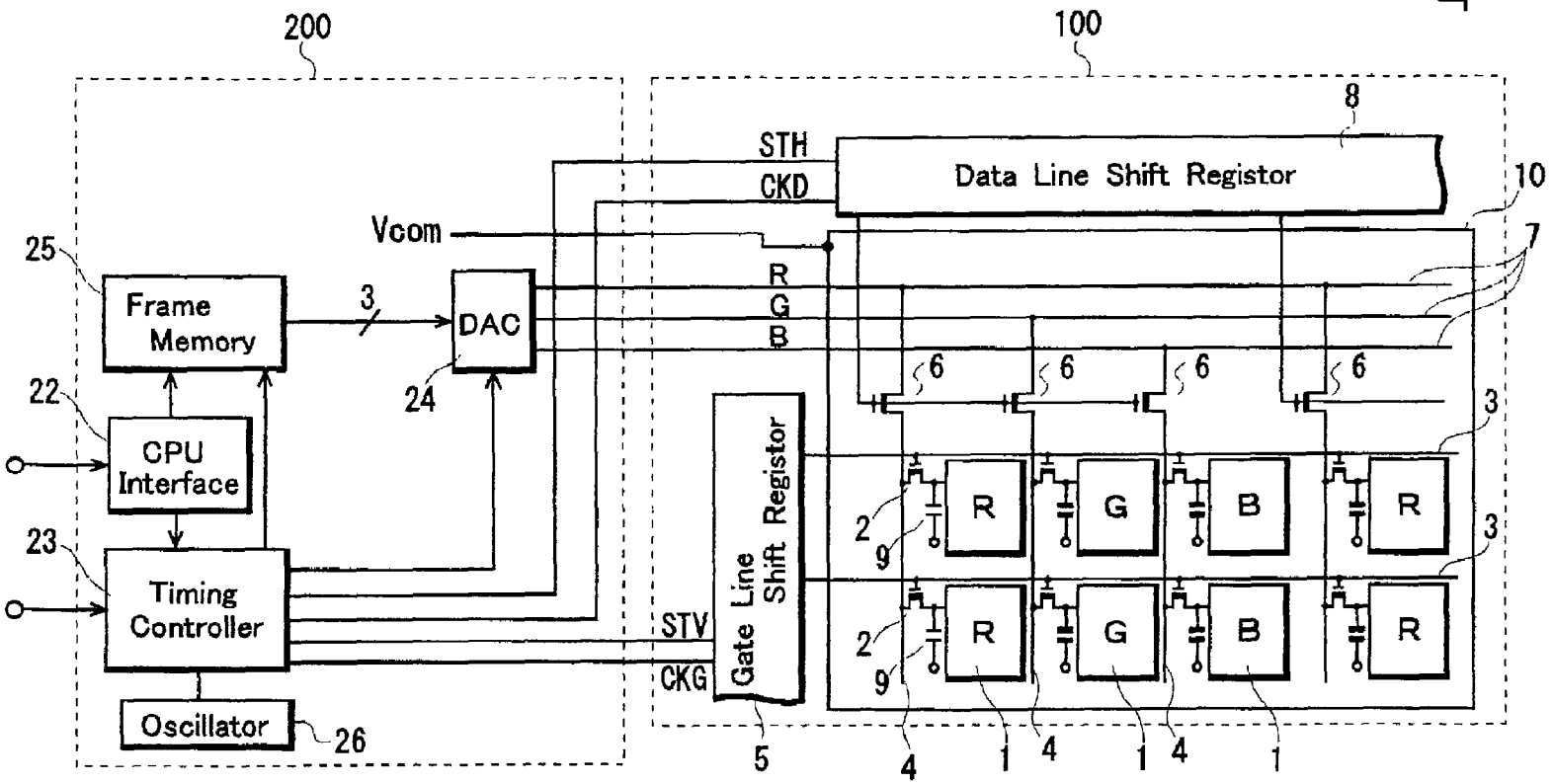
Fig.7 PRIOR ART
FIG. 7 is a circuit diagram of a conventional active matrix liquid crystal display device.

FIG. 1 shows a display device of an embodiment of this invention. The same components as those in the device of FIGS. 4 or 7 are denoted by the same reference numerals and the explanation about these components will be omitted. A liquid crystal panel 100 of this embodiment is the same as that of the prior arts. In a control circuit 200 of this embodiment, however, a data processing unit 21 and a frame memory 25 are placed. Also, a selector 27, which selects output of the data processing unit 21 or output of the frame memory 25, is provided for switching between a moving image mode and a still image mode. In the moving image mode, the data processing unit 21 produces and outputs a signal suitable for the LCD panel 100 by adjusting the brightness and contrast and applying the gamma correction to the consecutively inputted image signal. And a moving image is displayed based on this signal. In the still image mode, a still image is displayed based on the image signal stored in the frame memory.

In this embodiment, the switching between the moving image mode with a fast imaging speed for displaying a moving image and the still image mode with a slow imaging speed and relatively small power consumption for displaying the still image is made so that the power consumption of the display device can be kept low. In one of use cases of the device, the still image mode is a default use mode. In this case, when a moving image signal is received, or when a user performs a key operation, a CPU, which controls a device with the display device such as cellular phone and PDA, outputs a signal for making the switch from the still image mode to the moving image mode. Then, the CPU outputs a signal for making the switch from the moving image mode to the still image mode when a certain amount of time elapses after a completion of the moving mode, or after the user finishes the key operation. The switching signal is outputted to a CPU interface 22 from the CPU through a timing controller 23, which then performs the switching of the selector 27. The output from the data processing unit 21 and the output from the frame memory 25 is selected, making the switch between the moving image mode and the still image mode.

Figure 5:
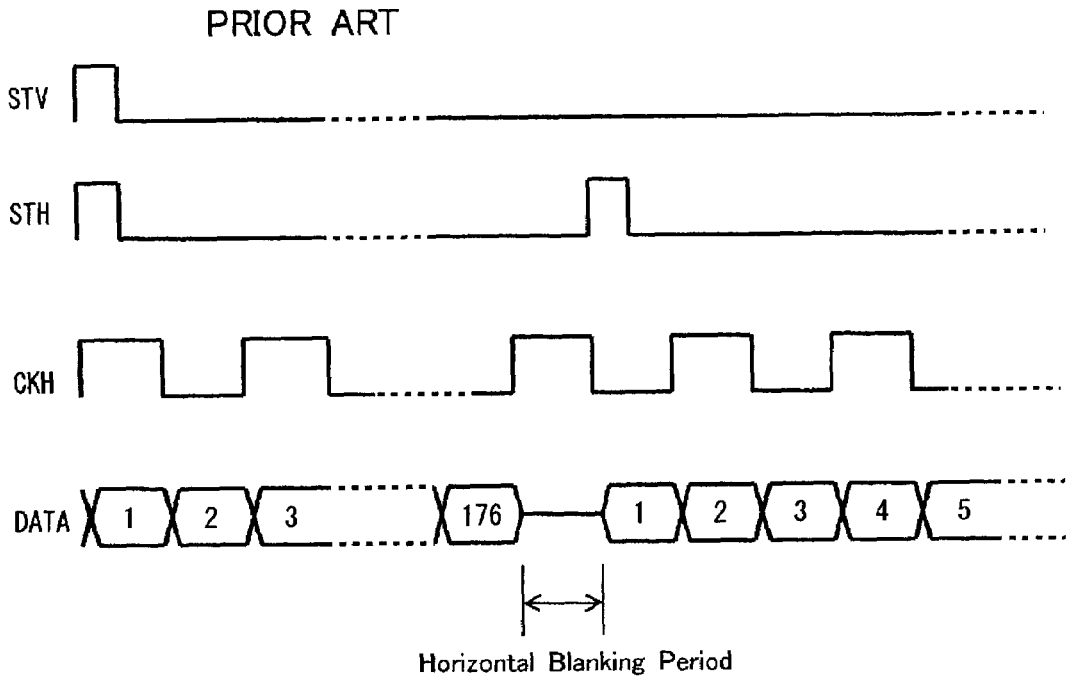
FIG. 5 is a timing chart showing a horizontal blanking period of the device of FIG. 4.
Figure 6:
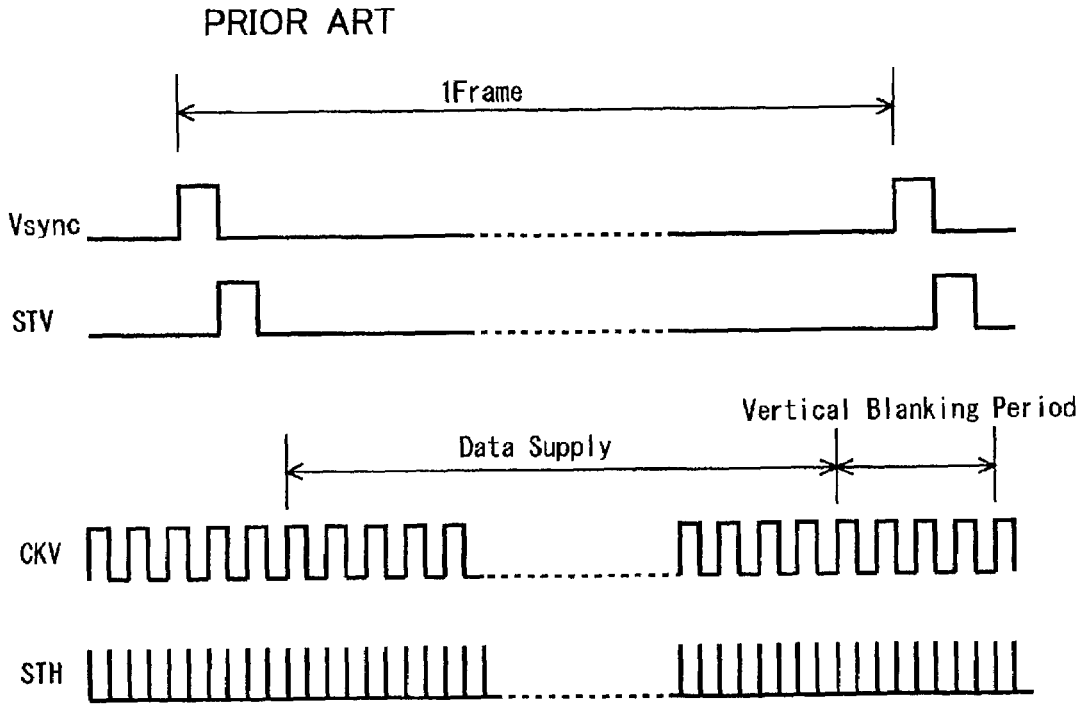
FIG. 6 is a timing chart showing a vertical blanking period of the device of FIG. 4.

During the moving image mode, the display operation is performed based on the timing signals shown in FIGS. 5 and 6 in the same manner as the conventional devices. In the moving image mode, various kinds of timing signals are external timing signals produced by using a clock extracted from the image signal inputted from outside. And in the still image mode, an internal timing signal produced based on a base clock outputted from an oscillator 26 connected to the timing controller 23 is used. Although these timing signals are basically the same signal, the external timing signal extracted from the external signal and the internal timing signal outputted from the oscillator 26 provided inside the device are differentiated and referred to differently in this specification. For example, among vertical synchronous signals Vsync, the signal extracted from the external signal will be indicated as the external vertical synchronous signal and the signal based on the output from the oscillator will be referred to as the internal vertical synchronous signal.

The display device of this embodiment can be basically operable in the same manner as the device of FIGS. 4 and 7. However, the manner for selecting the operation modes is different. Since the external timing signal and the internal timing signal are produced independently from each other, the external vertical synchronous signal and the internal vertical synchronous signal are not totally synchronized. Also, the switching signal for switching between the modes is inputted from the CPU of the device through the CPU interface. And the command for this operation is totally independent from both of the timing signals.

First, a first embodiment relating to the mode switching will be explained. In this embodiment, the switching from the moving image mode to the still image mode will be explained. When a mode-switching signal is inputted, a horizontal counter and a vertical counter of the timing controller are forcibly reset and the display scanning begins from the pixel located at the first row of the first column in the newly selected mode. That is, when the mode-switching signal is inputted, the timing controller 23 outputs a vertical start signal STV and a horizontal start signal STH, starting the operation of a shift register. In this case, inside the timing controller 23, there are counters for counting a gate line clock CKV and a data line clock CKH for determining the location of the pixel in terms of row and column provided with the pixel voltage. However, there is a need to reset this counter.

The first embodiment has the following problem. Since the mode-switching signal is not synchronized with the vertical synchronous signal, it is usually inputted during the frame period. However, before this frame period begins, a gate line shift register 5 and a data line shift register 8 have already started the operation. Suppose the pixel in the n-row of the m-column is provided with the pixel voltage. When the mode-switching signal is inputted under this condition, the counter is forcibly reset, starting the supply of the pixel voltage from the pixel located at the first row of the first column. However, the shift register is to select both the pixel at the first row of the first column and the pixel at the n-th row of the m+1th row. As a result, at the frame with the mode-switching is done, the second row and the n+1th row, the third row and the n+2th row are both selected simultaneously, displaying the same images at the upper portion and the lower portion of the screen.

Figure 2:
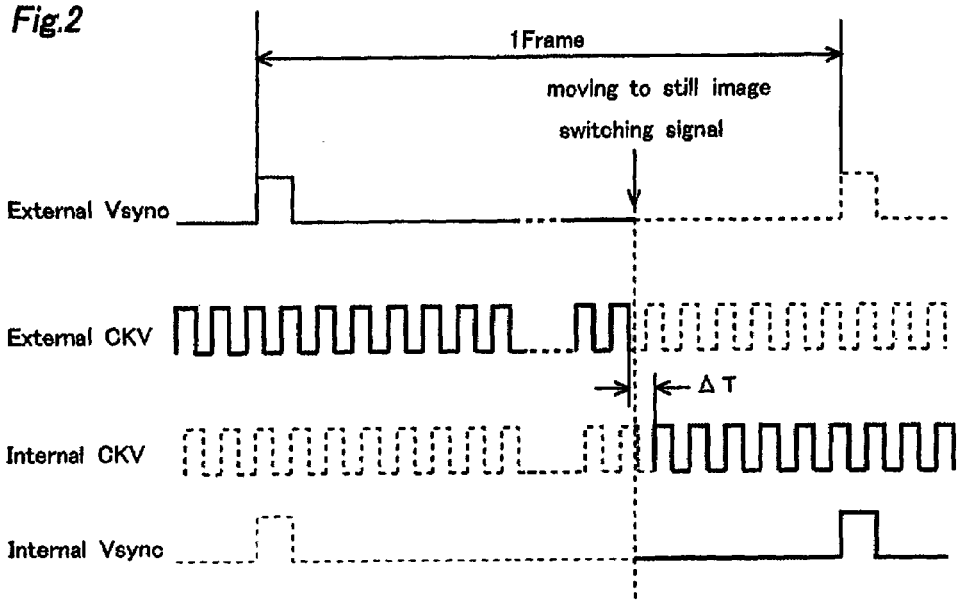
FIG. 2 is a timing chart showing a switching timing from a moving image mode to a still image mode of the device of FIG. 1.

Next, the second embodiment with the better mode-switching scheme will be explained. The switching from the moving image mode to the still image mode will be explained. FIG. 2 is the timing chart for making ae switch from the moving image mode to the still image mode. As mentioned above, when an image is displayed in the moving image mode, the operation is based upon the external timing signal inputted from outside. When the image signal is digital, the external timing signal is inputted as the timing signal itself. However, when the image signal is an analog signal such as a NTSC and a PAL, the external timing signal is extracted from the image signal. In some cases, the signal is extracted inside of the control circuit 200, it will be, however, referred to as the external timing signal here. Suppose the switching signal for making the switch from the moving image mode to the still image mode (it will be indicated as the moving to still image switching signal) is received. The vertical counter inside of the timing controller is reset by the vertical start signal STV for counting the gate line clock CKV and the horizontal counter is reset by the horizontal start signal STH for counting the data line clock CKH, resulting in the counting value of (n, m) of these counters. Therefore, this counting value is showing the coordinates of the pixel provided with the pixel voltage at this moment. If the image signal is read out from the address of the frame memory 25 corresponding to this counting value, the image signal corresponding to the next pixel electrode can be read out from the frame memory 25. When the moving to still image switching signal is inputted to the timing controller 23 through the CPU interface 22, the internal timing signal can be outputted without resetting the counting value of the vertical counter or the horizontal counter. Then the selector 27 is switched for selecting the frame memory 25, and the switching to the still image mode is immediately made. The image signal is supplied to the next pixel electrode from the corresponding address of the frame memory 25. In this way, two gate lines are not selected at the same time. Thus, there is no messy display upon the switching between the modes.

Although the data clock (the base clock) of the external timing signal and the base clock outputted from the oscillator 26 are not synchronized, it does not cause any problem because the counter inside of the timing controller is not reset. The operation stops just a short period of time, about one cycle of the base clock upon the switching between the modes. In this embodiment, the timing controller 23 is set up not to output the clock shorter than one base clock for preventing the false operation. Therefore, upon the switching between the modes, the operation stops for more than one cycle of the base clock, about the Δ t period shown in the figure.

Figure 3:
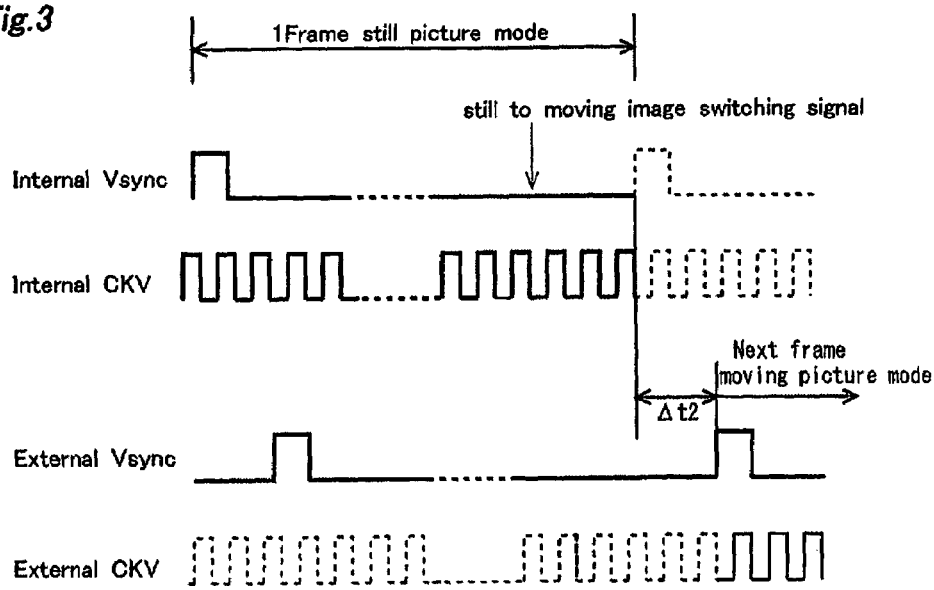
FIG. 3 is a timing chart showing the switching timing from the still image mode to the moving image mode of the device of FIG. 1.

Next, the switching from the still image mode to the moving image mode will be explained. FIG. 3 is a timing chart of the switching from the still image mode to the moving image mode. When the switching signal for making the switch from the still image mode to the moving image mode (it will be indicated as the still to moving image switching signal) is received, the switching of the operation is not particularly performed. The operation by the internal timing signal based on the output of the oscillator 26, that is, the still image mode continues till the end of the frame memory. The next internal vertical synchronous signal is not outputted. Then, after the Δ t2 period passes, the external vertical synchronous signal is inputted. Therefore, at the beginning of the frame period after the external vertical synchronous signal is inputted, the mode is switched to the moving image mode based on the external timing signal. In this way of switching, two gate lines are not selected at the same time. Thus, there is no messy display upon the switching between the modes.

During the Δ t2 period between the still image mode and the moving image mode, there is no need to supply the clock. However, since it is difficult to stably supply the various external timing signals simultaneously with the input of the external vertical synchronous signal, the external timing signal should be outputted several base clocks prior to the input of the external vertical synchronous signal. During the Δ t2 period, although the timing signal is supplied, the shift resisters 5, 8 do not start the operation because the vertical start signal STV or the horizontal start signal STH are not supplied. It is also possible to switch to the external timing signal immediately after the frame period of the still image mode.

In the still image mode, the image signal and the timing signal are supplied within the control circuit 200. But in the moving image mode, the image signal is supplied from outside and the still image is displayed in the synchronization with the external signal. Therefore, in the second embodiment, the switching timing from the still image mode to the moving image mode and the switching timing from the moving image mode to the still image mode are different from each other. Each switching is performed through the most preferable procedure, improving the display quality.

In the embodiments described above, the liquid crystal display device is explained as an example of the active matrix display device. However, this invention is not limited to these embodiments. It is also applicable to EL display device, LED display device and vacuum luminescence display device.

The display device of this invention makes the display by making the switch between two modes; the moving image mode with the rapid imaging speed where the image is displayed based on the output from the data processing unit 21, and the still image mode with small power consumption where the image is displayed based on the output of the memory 25. Therefore, the display device with the small power consumption and yet with the high quality display is achieved.

Furthermore, the switching timing from the still image mode to the moving image mode and the switching timing from the moving image mode to the still image mode are different from each other. Each switching is performed through the most preferable procedure, improving the display quality.

In the active matrix display device having the data processing unit 21 consecutively outputting the image signal after performing a certain processing to the image signal consecutively inputted, the memory element 25 holding the image signal for a plurality of pixels, and the switching device selecting the data processing unit or the memory element, the configuration of the display panel 100 can be exactly the same as that of the conventional devices. Only the configuration of the control circuit 200 should be modified, suppressing the manufacturing cost.

When the still to moving image switching signal is received during the frame period in the still image mode, the still image mode continues till the end of this particular frame period and the next internal vertical synchronous signal is not produced. Then, after this frame period, when the next external vertical synchronous signal is inputted, the display in the moving image mode starts. Therefore, the device of this invention can be embodied with a relatively simple configuration.

Also, since it is possible to read out the image signal from the address of the memory corresponding to the counting value of the vertical counter and the horizontal counter when the moving to still image switching signal is received, the device of this invention can be embodied with a relatively simple configuration.

What is claimed is:

1. An active matrix display device comprising:

a plurality of gate lines disposed in a direction;

a plurality of data lines disposed in a direction different from the direction of the gate lines;

a plurality of switching elements each disposed at corresponding intersections of the gate lines and the data lines;

a plurality of pixel electrodes connected to corresponding switching elements so that a set of image signals can be supplied to the pixel electrodes from the data lines during a frame period, a plurality of pixels having corresponding pixel electrodes;

a data processing unit receiving, processing and outputting the set of the image signals for displaying a moving image in a moving image mode;

a memory holding the set of the image signals for displaying a still image in a still image mode; and a digital-analog converter performing a digital-to-analog conversion on the set of the image signals sent from the memory and supplying the converted image signals to the pixel electrodes.

2. The active matrix display device of claim 1, further comprising a switching device selecting the data processing unit in the moving image mode or the memory in the still image mode.

3. The active matrix display device of claim 1, wherein a switching timing from the still image mode to the moving image mode and a switching timing from the moving image mode to the still image mode are different.

4. The active matrix display device of claim 1, wherein the still image mode continues until an end of the frame period when a switching signal for switching from the still image mode to the moving image mode is received during the frame period and the moving image mode starts from a next frame period.

5. The active matrix display device of claim 4, wherein the display device operates based on an external vertical synchronous signal which is a timing signal outputted at a beginning of the frame period as a pulse and synchronized with the image signals inputted from outside in the moving image mode and the display device produces an internal vertical synchronous signal inside the device in the still image mode, the still image mode continues until the end of the frame period without producing a next internal vertical synchronous signal when the switching signal is received during the frame period in the still image mode, and the moving image mode begins when the frame period is completed and the display device receives the external vertical synchronous signal.

6. The active matrix display device of claim 4, wherein a switching timing from the still image mode to the moving image mode and a switching timing from the moving image mode to the still image mode are different.

7. The active matrix display device of claim 1, wherein an image signal is read out from an address of the memory corresponding to one of the pixels provided with a pixel voltage when a switching signal for switching from the moving image mode to the still image mode is received during the frame period and the still image mode starts immediately when the switching signal is received.

8. An active matrix display device comprising:

a plurality of gate lines disposed in a direction, each of the gate lines being consecutively selected based on a gate line clock;

a plurality of data lines disposed in a direction different from the direction of the gate lines, each of the data lines being consecutively selected based on a data line clock;

a plurality of switching elements each disposed at corresponding intersections of the gate lines and the data lines;

a plurality of pixel electrodes connected to corresponding switching elements so that a set of image signals can be supplied to the pixel electrodes from the data lines during a frame period, a plurality of pixels having corresponding pixel electrodes; and a memory holding the set of the image signals for displaying a still image in a still image mode, wherein the display of the still image starts immediately when a switching signal for switching from a moving image mode to the still image mode is received during the frame period by reading out an image signal from an address of the memory corresponding to one of the pixels provided with a pixel voltage when the switching signal is received.

9. The active matrix display device of claim 8, further comprising a vertical counter counting the gate line clock, a horizontal counter counting the data line clock, or a combination of the vertical counter and the horizontal counter, wherein the image signal is read out from the address of the memory based on a counted value of the vertical counter, a counted value of the horizontal counter, or counted values of the vertical and horizontal counters when the switching signal for switching from the moving image mode to the still image mode is received.

10. The active matrix display device of claim 8, wherein a switching timing from the still image mode to the moving image mode and a switching timing from the moving image mode to the still image mode are different.

11. A control device of an active matrix display device displaying a moving image or a still image in a frame period, the display device including pixels having corresponding pixel electrodes, a set of image signals being supplied to the pixel electrodes, the control device comprising:

a data processing unit receiving, processing and outputting the set of the image signals for displaying the moving image;

a memory holding the set of the image signals for displaying the still image;

a digital-analog converter performing a digital-to-analog conversion on the set of the image signals sent from the memory and supplying the converted image signals to the pixel electrodes; and a switching device selecting the data processing unit or the memory.

12. The control device of an active matrix display device of claim 11, wherein a switching timing from the data processing unit to the memory and a switching timing from the memory to the data processing unit are different.

13. The control device of an active matrix display device of claim 11, wherein the memory is selected until an end of the frame period when a switching signal for switching from the memory to the data processing unit is received during the frame period and the data processing unit is selected from a next frame period.

14. The control device of an active matrix display device of claim 13, further comprising a timing controller outputting internal timing signals including an internal vertical synchronous signal outputted as a pulse for the frame period.

15. The control device of an active matrix display device of claim 14, further comprising an oscillator connected to the timing controller, wherein the device operates based on external timing signals including an external synchronous signal outputted at a beginning of the frame period and synchronizes with the set of the image signals inputted from outside while the data processing unit is selected, the display device operates based on the internal vertical synchronous signal produced by the timing controller according to an output from the oscillator while the memory is selected, and the timing controller continues to produce the internal timing signals but does not produce a next internal vertical synchronous signal when the switching signal is received while the memory is selected, and the operation of the display device based on the external timing signals resumes after the frame period ends when a next external vertical synchronous signal is inputted.

16. The control device of an active matrix display device claim 14, wherein a switching timing from the data processing unit to the memory and a switching timing from the memory to the data processing unit are different.

17. The control device of an active matrix display device of claim 11, wherein an image signal is read out from an address of the memory corresponding to one of the pixels provided with a pixel voltage when a switching signal for switching from the data processing unit to the memory is received during the frame period and the memory is selected immediately when the switching signal is received.

18. A control device of an active matrix display device displaying a moving image or a still image in a frame period, the display device including pixels having corresponding pixel electrodes, a plurality of gate lines and a plurality of data lines, a set of image signals being supplied to the pixel electrodes, the control device comprising:

a data processing unit receiving, processing and outputting the set of the image signals for displaying the moving image;

a memory holding the set of the image signals for displaying the still image;

a switching device selecting the data processing unit or the memory; and a timing controller outputting internal timing signals including an internal vertical synchronous signal outputted as a pulse for the frame period, a gate line clock for selecting one of the gate lines and a data line clock for selecting one of the data lines, wherein an image signal is read out form an address of the memory corresponding to a gate line and a data line which are selected when a switching signal for switching from the data processing unit to the memory is received so that the displaying of the still image starts immediately when the switching signal is received.

19. The control device of an active matrix display device of claim 18, further comprising a vertical counter counting the gate line clock, a horizontal counter counting the data line clock, or a combination of the vertical counter and the horizontal counter, wherein the image signal is read out from the address of the memory based on a counted value of the vertical counter, a counted value of the horizontal counter, or counted values of the vertical and horizontal counters when the switching signal is received.

20. The control device of an active matrix display device of claim 18, wherein a switching timing from the memory to the data processing unit and the switching timing from the data processing unit to the memory are different.

21. An active matrix display device comprising:

a plurality of gate lines disposed in a direction;

a plurality of data lines disposed in a direction different from the direction of the gate lines;

a plurality of switching elements each disposed at corresponding intersections of the gate lines and the data lines;

a plurality of pixel electrodes connected to corresponding switching elements so that an image signal can be supplied to the pixel electrodes from the data lines during a frame period, a plurality of pixels having corresponding pixel electrodes;

a data processing unit receiving, processing and outputting the image signal for displaying a moving image in a moving image mode; and a memory holding the image signal for displaying a still image in a still image mode, wherein a switching from the still image mode to the moving image mode is always made at an end of the frame period, and a switching from the moving image mode to the still image mode is made prior to the end of the frame period.

22. An active matrix display device comprising:

a plurality of gate lines disposed in a direction, each of the gate lines being consecutively selected based on a gate line clock;

a plurality of data lines disposed in a direction different from the direction of the gate lines, each of the data lines being consecutively selected based on a data line clock;

a plurality of switching elements each disposed at corresponding intersections of the gate lines and the data lines;

a plurality of pixel electrodes connected to corresponding switching elements so that an image signal can be supplied to the pixel electrodes from the data lines during a frame period, a plurality of pixels having corresponding pixel electrodes; and a memory holding the image signal for displaying a still image in a still image mode, wherein the still image mode starts immediately when a switching signal for switching from a moving image mode to the still image mode is received during the frame period by reading out an image signal from an address of the memory corresponding to one of the pixels provided with a pixel voltage when the switching signal is received, wherein a switching from the still image mode to the moving image mode is made at an end of the frame period, and a switching from the moving image mode to the still image mode is made during the frame period.

23. A control device of an active matrix display device displaying a moving image or a still image in a frame period, the display device including pixels having corresponding pixel electrodes, an image signal being supplied to the pixel electrodes, the control device comprising:

a data processing unit receiving, processing and outputting the image signal for displaying the moving image;

a memory holding the image signal for displaying the still image; and a switching device selecting the data processing unit or the memory, wherein a switching from the data processing unit to the memory is made prior to an end of the frame period, and a switching from the memory to the data processing unit is always made at the end of the frame period.

24. A control device of an active matrix display device displaying a moving image or a still image in a frame period, the display device including pixels having corresponding pixel electrodes, a plurality of gate lines and a plurality of data lines, an image signal being supplied to the pixel electrodes, the control device comprising:

a data processing unit receiving, processing and outputting the image signal for displaying the moving image;

a memory holding the image signal for displaying the still image;

a switching device selecting the data processing unit or the memory; and a timing controller outputting internal timing signals including an internal vertical synchronous signal outputted as a pulse for the frame period, a gate line clock for selecting one of the gate lines and a data line clock for selecting one of the data lines, wherein an image signal is read out form an address of the memory corresponding to a gate line and a data line which are selected when a switching signal for switching from the data processing unit to the memory is received, and the memory is selected immediately when the switching signal is received, and wherein a switching from the memory to the data processing unit is always made at an end of the frame period, and the switching from the data processing unit to the memory is made prior to the end of the frame period.

* * * * *